US005330100A

United States Patent [19]

Malinowski

[11] Patent Number: 5,330,100

[45] Date of Patent: Jul. 19, 1994

[54] ULTRASONIC FUEL INJECTOR

[76] Inventor: Igor Malinowski, 995 Deep Valley Dr., Box 2981, Palos Verdes Estates, Calif. 90274

[21] Appl. No.: 825,912

[22] Filed: Jan. 27, 1992

[51] Int. Cl.[5] ..... F02M 61/06; B05B 17/06

[52] U.S. Cl. ..... 239/102.2; 239/585.4

[58] Field of Search ..... 239/102.2, 585.4, 289, 239/585.1

[56] References Cited

U.S. PATENT DOCUMENTS

| | | | |
|---|---|---|---|
| 4,105,004 | 8/1978 | Asai et al. . | |
| 4,167,158 | 9/1979 | Martin et al. . | |
| 4,237,836 | 12/1980 | Tanasawa et al. . | |
| 4,251,031 | 2/1981 | Martin et al. | 239/102.2 |
| 4,590,915 | 5/1986 | Yamauchi et al. . | |
| 4,723,708 | 2/1988 | Berger et al. | 239/102.2 |
| 4,974,780 | 12/1990 | Nakamura et al. | 239/102.2 |
| 4,978,067 | 12/1990 | Berger et al. | 239/102.2 |
| 5,169,067 | 12/1992 | Matsusaka et al. | 239/102.2 |

FOREIGN PATENT DOCUMENTS

| | | | |
|---|---|---|---|
| 122154 | 10/1978 | Japan | 239/102.2 |
| 5545 | 1/1982 | Japan | 239/102.2 |
| 70863 | 3/1991 | Japan | 239/585.4 |
| 222853 | 10/1991 | Japan | 239/102.2 |

*Primary Examiner*—Andres Kashnikow
*Assistant Examiner*—William Grant
*Attorney, Agent, or Firm*—Lewis B. Sternfels; Deanna C. Bushendorf

[57] ABSTRACT

A sealing shaft (23) with a conical male surface (48) is seated in a female conical valve seat (15). Sealing shaft (23) is attached to a pole piece (13) which, when energized by a solenoid coil (30), causes the sealing shaft to be pulled away from valve seat (15), resulting in release of fuel. A hollow ultrasonic horn actuator assembly (54), having a tapered part (11), includes a plurality of crystal actuators (14) to generate and amplify ultrasonic vibrations and to disperse and atomize the fuel as it passes through a narrow opening (45) in ultrasonic horn actuator assembly (54). Tapered part (11) and a compression member (12) are held together by a threaded stud (19). Horn actuator assembly (54) is centered about a sealing shaft (23) for flow of the fuel around the sealing shaft and inside the horn actuator assembly for release to an intake manifold of an engine through small opening (45).

8 Claims, 3 Drawing Sheets

ULTRASONIC FUEL INJECTOR

BACKGROUND OF INVENTION

This invention relates to fuel injection and injectors used in combustible engines. Fuel injectors may be defined as fuel supply devices which provide an intermittent supply of fuel to an intake manifold or cylinder of an engine. Conventional fuel injectors do not generate uniformly sized and distributed drops of fuel. The size and distribution of the fuel drops is significant to ensure complete mixing of air and fuel and, thereby to ensure efficient combustion in a cylinder of an engine. A nonuniform fuel to air mixture, as resulting from conventional fuel injection systems, induces reduced combustion efficiency and degradation of exhaust purification efficiency, both being factors in increasing fuel consumption and increased amounts of exhaust. This invention relates to devices which use ultrasound in dispersing fuel during injection in order to achieve a better dispersion of fuel and more even fuel air mix, resulting in greater efficiency and cleanliness of an engine.

DESCRIPTION OF THE PRIOR ART

Yamauchi in U.S. Pat. No. 4,590,915, issued on May 27, 1986 describes a "Multi Cylinder Fuel Atomizer for Automobiles," which provides an additional means of ultrasonic dispersion through the use of an ultrasonic horn in the passage from a carburetor to an inlet manifold of the engine. A separate ultrasonic oscillator, built into a manifold, serves as the means by which fuel is dispersed into the several cylinders.

Asai, in U.S. Pat. No. 4,105,004, describes an "Ultrasonic Wave Fuel Injection and Supply Device" comprising a separate vibratory member and a separate injection means, for injecting fuel onto the vibratory member. The vibratory member serves only as a means of dispersion and is not integrated with a fuel injector.

Martin, in U.S. Pat. No. 4,167,158, describes a "Fuel Injection Apparatus" which comprises a vibrating fuel injector and a vibrating plate onto which fuel is injected from the injector. As in Pat. No. 4,105,004, the vibratory dispersion member serves only as a means of dispersion and is not integrated with a fuel injector.

Tanasawa U.S. Pat. No. 4,237,836 describes a "Fuel Supply System Employing Ultrasonic Vibratory Member of Hollow Cylindrically Shaped Body." Here, a vibratory dispersion member is located in the manifold and, although of hollow shape, serves only as a means of dispersion and is not integrated with a fuel injector.

BRIEF SUMMARY OF THE PRESENT INVENTION

The device of the present invention serves the purpose of delivering atomized fuel to an inlet manifold of an internal combustion engine. Performance of the engine is tied to the degree of fuel atomization. An increase in the atomization of the fuel into a mist provides a proportionately better mix between the fuel and the air, thus resulting in more efficient combustion.

Ultrasonic fuel injectors of the present invention utilize a sealing shaft with a conical male tip which is seated in a female conical valve seat. The sealing shaft is attached to a pole piece, which can be activated with a solenoid coil. The solenoid coil, when energized, causes the sealing shaft to be pulled away from the valve seat and results in the release of fuel.

The proposed device of the present invention uses a hollow, ultrasonic horn actuator assembly as a dispersion means to atomize the fuel into mist. The fuel leaves through a narrow opening in the ultrasonic horn actuator assembly.

The horn actuator assembly, which serves to generate and amplify ultrasonic vibrations, includes a plurality of piezoelectric crystal actuators, a tapered horn part, a compression member, and all components are held together by a threaded stud. The horn actuator assembly is hollow around the sealing shaft, so that fuel will flow around the sealing shaft inside the horn actuator assembly and be released to an intake manifold of an engine through an opening in the center of the horn part. The horn part oscillates and, thus, causes the liquid to be atomized as it comes in contact with the oscillating end of the horn part to which the amplified oscillations are applied.

| Numerals used: | |
|---|---|
| 10 | Horn part |
| 11 | Tapered part or end of horn |
| 12 | Compression member |
| 13 | Pole piece |
| 14 | Crystal actuators |
| 15 | Conical valve seat |
| 16, 216 | Electrode |
| 216a | Elongated extension of electrode 216 |
| 17 | O-ring of housing, front |
| 18 | O-ring of horn, front |
| 19 | Threaded stud |
| 20 | O-ring of horn, back |
| 21 | Insulating tape |
| 22 | O-ring of solenoid, front |
| 23 | Sealing shaft |
| 24 | Preload spring |
| 26 | Electrical connector |
| 28 | Inner housing |
| 29 | Stop plate |
| 29a | Slot in plate 29 |
| 30 | Solenoid coil |
| 32 | Outer housing |
| 34 | O-ring, solenoid, back |
| 36 | Front cap |
| 38 | Tube fitting |
| 39 | Solenoid spool or housing |
| 40 | Back plate |
| 41 | End manifold |
| 42 | O-ring, fitting |
| 43 | Fuel Filter |
| 44 | Potting |
| 45 | Stepped bore |
| 45a | Fuel outlet opening |
| 45b | Internally threaded cylindrical surface |
| 46 | Swaged portion of inner housing |
| 47 | Bore opening |
| 48 | Conical surface of shaft 23 |
| 49 | Large diameter section of 23 |
| 49a | Flat portions of shaft 23 |
| 50 | Solenoid core |
| 52 | Connector |
| 54 | Horn driver assembly |
| 56 | Large diameter section of horn part |
| 158 | Valve seat insert |
| 60 | Internal conical surface |
| 62 | Small diameter section of horn part |
| 64 | Outside layer of insulating tape |
| 66 | Threads of inner housing |
| 68 | Stop washer |
| 70 | Connector housing |
| 72 | O-ring, horn rear |
| 74 | Shoulder on shaft 23 |
| 76 | Holder insert |
| 78 | Seal material |

DRAWINGS

FIG. 1-A shows a cross-sectional view of a typical embodiment.

FIG. 1-B shows a velocity and stroke distribution in a horn driver assembly of a typical embodiment.

DESCRIPTION

Figure 1A:
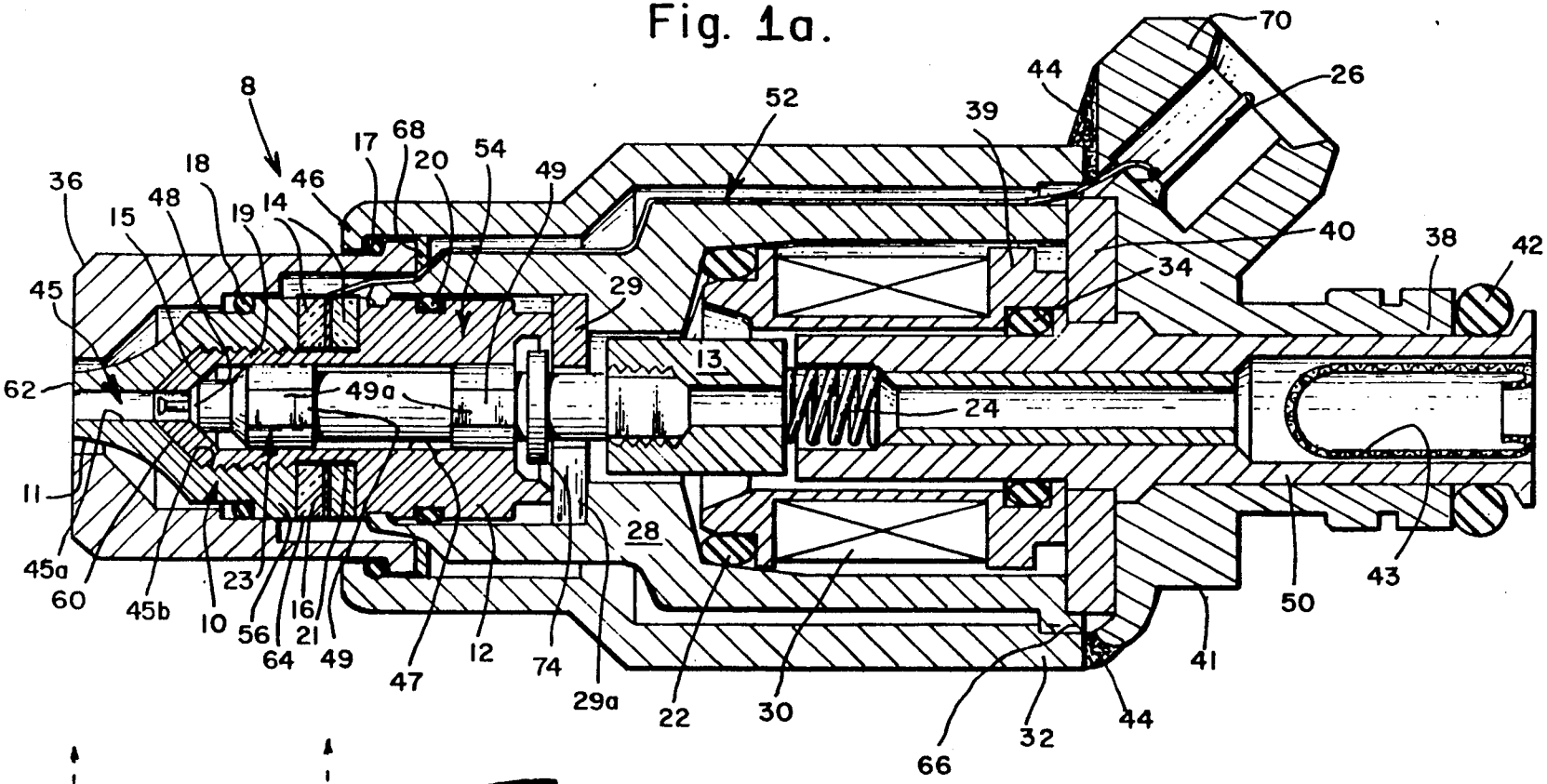
Figure 1B:
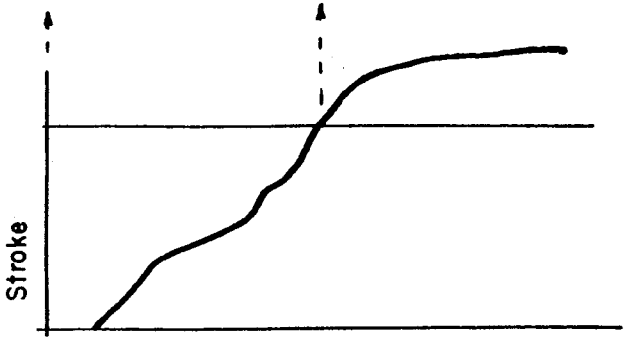

FIG. 1-A shows a cross sectional view of a typical embodiment of the present invention comprising a fuel injector 8.

A horn driver assembly 54, includes a horn part 10, having an externally tapered part or end 11, and a plurality of crystal actuators 14, typically two crystals, which are separated by an electrode 16. A compression member 12, having a threaded stud 19, is threaded into horn part 10, and clamps crystal actuators 14 to horn part 10. Horn part 10 is preferably made of a titanium-aluminum-vanadium alloy, an alloy which is generally known in the trade as Ti6A14V. The horn part is shaped by the processes of turning, drilling and tapping. The horn part, which is approximately 12.7 millimeters long, has a large diameter section 56, whose outside diameter is on the order of 11 millimeters, and a small diameter section 62, whose outside diameter is on the order of 1.5 to 3.8 millimeters. This reduction in large to small diameter sections in horn part 10 forms the taper in tapered end 11.

Horn part 10 is provided with a stepped bore 45 comprising a generally cylindrical fuel outlet opening **45*a* of small diameter positioned within tapered end 11, and a relatively larger internally threaded cylindrical surface 45*b* joined to opening 45*a* by an internal conical surface 60. Bore 45*a* has an internal diameter on the order of 0.5 to 1.6 millimeters. Large bore 45*b* is partially threaded, and has a diameter on the order of 5 to 7 millimeters. Stepped bore 45 in horn part 10 is manufactured preferably through a process of drilling, reaming and tapping. Internal conical surface 60 is used seal with threaded stud 19**.

As stated above, actuator pair 14 is clamped between horn part 10 and compression member 12. This clamping is effected by use of externally threaded stud 19 which is formed as a part of compression member 12 and which is engaged with an internally threaded surface on horn part 10.

Crystal actuators 14 are preferably made of PZT piezoelectric ceramic, and have an external diameter on the order of 11 millimeters, an internal diameter on the order of 6.4 millimeters, and a thickness on the order of 1.6 millimeters. PZT is an abbreviation for lead zirconate-titanate piezoelectric, ceramic piezoelectric material such as type EC-66, manufactured by EDO Corporation, Salt Lake City, Utah. Crystal actuators 14 are insulated on their interior surfaces from stud 19 by a layer of polyimide insulating tape 21, and on their outside surfaces by a layer of polyimide insulating tape 64.

An electrode 16, which is made of beryllium copper, is placed between crystal actuators 14. Electrode 16 delivers a sinusoidally oscillating electrical voltage signal on the order of 100 V to 300 V and is electrically coupled to a connector 26 by a conductor 52. Connector 26 is coupled to an electronic driver board (not shown). Electrode 16 is shaped in form of an annulus with inside and outside diameters which match those of crystal actuators 14 and conductor 52. Conductor 52 comprises a narrow strip of beryllium copper sheet approximately 1 millimeter wide and 0.1 millimeter thick, and is soldered to connector 26.

Conductor 52 is typically insulated on both sides by a layer of polyimide insulating tape, such as the one manufactured by 3-M Corp., Minneapolis, Minn.

Compression member 12 is held in an inner housing 28 by a swaged portion 46 of the inner housing swaged into a groove of compression member 12, and sealed with a conventional O-ring 20 at its back. Grooves respectively on a perimeter of compression member 12 and on a perimeter of front cap 36 respectively accommodate an O-ring 20 and a swaged portion 46.

Compression member 12 and its peripheral threaded stud 19 have a cylindrical bore or opening 47. A sealing shaft 23 is positioned inside bore 47. Member 12 and stud 19 are made preferably of hard stainless steel, such as 440 type, and preferably in one part, and is shaped by means of turning, threading, drilling and reaming. Bore 47 in stud 19 terminates in an inwardly facing conical valve seat 15, whose conical surface is angled at approximately ninety degrees.

Sealing shaft 23 is of conventional construction and is the type typically used for fuel injectors. Shaft 23 has a conical part 48 which is disposed to seal with conical seat 15 of threaded stud 19. Shaft 23 includes two spaced large diameter sections 49 whose dimensions generally equal that of bore 47. However, each large diameter section 49 is not fully cylindrical, but is provided with four flat portions **49*a* to facilitate the flow of fuel around shaft 23. The diameters of shaft 23 and bore 47 are on the order of 3 to 4 millimeters. In addition, shaft 23 has a shoulder 74, whose diameter is on the order of 5 millimeters. Shaft 23** is typically made of hard stainless steel such as 17-4 PH of 440 type.

Inner housing 28 is made of soft steel or stainless steel through the process of turning, and accommodates components of the fuel injector of the present invention.

A front cap 36, which is made preferably of ceramic, such as machinable ceramic manufactured by Macor, serves to protect horn part 10. In a variation of the present embodiment, front cap 36 may be made of a plastic, such as Teflon (trademark of E. I. Du Pont de Nemours and Co.), if the temperatures surrounding the fuel injector in an intake manifold of an engine are low enough to permit the use of a plastic part.

Front cap 36 is sealed with an O-ring 18 around horn part 10 at its front. O-ring 18 is of conventional manufacture and provides a seal between horn part 10 and the internal bore of front cap 36.

An outer housing 32, which is made of a mild or soft steel, is fitted over front cap 36 and inner housing 28. Housing 32 is sealed to front cap 36 through an O-ring 17 on the front of the outer housing. Housing 32 is connected with inner housing 28 through a set of interengaging mating threads 66. In the assembly of outer housing 32, threads 66 are tightened until end cap 36, which is pulled through the interengagement of O-ring 17 and the cooperating lips of cap 36 and outer housing 32, stops against a conventional stop washer 68 or a like feature of inner housing 28. Housing 32 thus serves to seal off and protect electrode 16, and its conductor 52.

A pole piece 13, made preferably of magnetically soft stainless steel such as type 430F (manufactured by Carpenter Corp, Reading, Pa.), is threaded onto the rear end of shaft 23. A light compression spring 24, compressed between pole piece 13 and a solenoid core 50, forces conical surface 48 of shaft 23 against valve seat 15.

Solenoid core 50, typically made of magnetically soft stainless steel 430F as mentioned before, comprises two parts (as shown). During operation, shaft 23 is pulled away from valve seat 15 when the magnetic force of a solenoid coil 30 acts upon core 50, until the shaft is stopped against a stop plate 29. Plate 29 is made of steel, preferably of stainless type, and has a slot 29*a* for ease of assembly over shaft 23.

Solenoid coil 30 comprises copper windings which are wound over a solenoid spool or housing 39, which is typically molded of plastic material. Solenoid housing 39 is sealed against inner housing 28 by an O-ring 22 at the front of solenoid housing 39 and against core 50 by an O-ring 34 at the back of the solenoid housing. Solenoid housing 39 is retained within an opening in inner housing 28 by a back plate 40. Plate 40 is made of steel of conventional type.

An end manifold 41 is threaded or swaged or otherwise affixed in any conventional manner to a threaded portion of outer housing 32 and to inner housing 28, and seals off solenoid core 50 with O-ring 34. An O-ring 42 is positioned on solenoid core 50 adjacent tube fitting 38 on end manifold 41. A potting compound 44 may be added as an additional seal between end manifold 41 and outer housing 32. End manifold 41 additionally may incorporate a connector housing 70 and tube fitting 38, all of which may be integrated in a molded together construction. Connector housing 70 accommodates connector 26, while tube fitting 38 permits connection of the fuel injector to an external hose.

Potting 44 typically comprises an epoxy potting compound, such as manufactured by Hexel Corporation.

A fuel filter 43, which is preferably of metal mesh type, is inserted into an opening in the back of core 50 for final fuel cleaning.

FIG. 1-B shows a graph representing a typical distribution of velocity and stress along horn driver assembly 54 when in resonance. As shown on the graph, the velocity of fuel injection is highest on small diameter section 62 of horn part 10 where its tapered end 11 terminates at fuel outlet opening 45*a*, second highest at the end of compression member 12 generally at the point where tapered end 11 begins its downward slope towards horn section 62, and at zero velocity at a point between the pair of crystal oscillators 14. For horn driver assembly 54 in this embodiment, resonance occurs at approximately 90 kHz at which point driver assembly 54 becomes a sonic one-half wavelength horn assembly, which refers to the proportion between the length of the horn assembly and the sound wavelength. Horn assembly 54 may operate in lower frequencies below its resonance point with lesser efficiency, which may still be accurate for application of fuel atomization.

Figure 2:
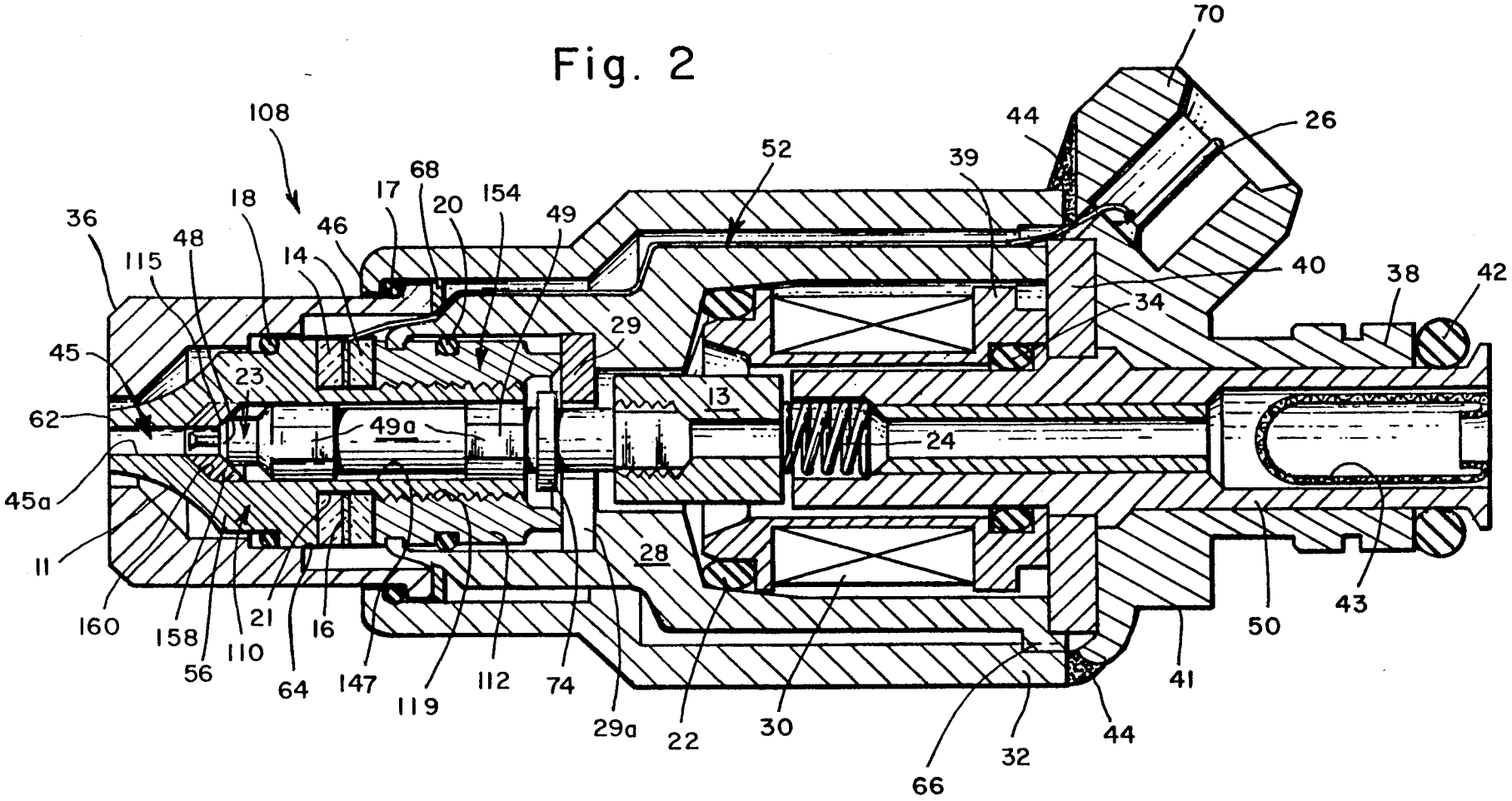
FIG. 2 shows a cross-sectional view of an alternative embodiment of the present invention.

FIG. 2 shows an alternative embodiment of the present invention comprising an injector 108. Because injector 108 has a construction which is essentially the same as that of injector 8 of FIG. 1-A, parts which are identical between the two injectors bear the same numerals, and only those not the same will be differently identified, as a "100" series. Here, a horn assembly 154 includes a horn part 110 which is made as one part and includes an integral threaded stud 119. As shown, stud 119 is externally threaded so that it can mate with an internal thread on a compression member 112. A valve seat insert 158 is press fitted in a bore 147 of horn part 110. Valve seat insert 158 is preferably made of hard stainless steel, such as 440 type, and hardened to have a hardness number on the order of 42 to 45 Rockwell. Insert 158 is pressed against a female conical surface 160 of horn part 110 at the end of bore 147. Bore 147 may have a slightly smaller diameter near its end to facilitate insertion of valve seat insert 158. Insert 158, being press fitted in bore 147, forms a seal on its perimeter with the internal wall of bore 147. Seat insert 158 contains a valve seat 115, which has an internal conical surface which is sealable against a mating surface on shaft 23. In this embodiment, shaft 23 is pushed against valve seat 115 of insert 158. It is preferred that valve seat 158 be an independent part so that it can be made of hard, stainless steel, instead of being integral with horn part 110, which is typically made of titanium alloy, because hard stainless steel is a more durable material than a titanium alloy. The selection of different materials is dependent upon the use of the components. It is desired that valve seat insert 158 withstand multiple, dynamic contact with shaft 23. Horn part 110 is made of titanium alloy for its advantageous sonic properties.

The advantage of the embodiment shown in FIG. 2 is to minimize a possible eccentricity between valve surface 115 and bore 147 which accommodates shaft 23, by means of a single drilling and reaming operation of conical surface 160 and bore 147, including the end of the bore into which insert 158 is press fitted. Insert 158 can be manufactured to provide a high concentricity of seat surface 115 and the outside diameter of insert 158, resulting in a high degree of concentricity between bore 147 and valve surface 115.

The difference between the embodiments depicted in FIGS. 1-A and 2 are as follows. In the embodiment of FIG. 1-A, valve surface 15 is formed in horn part 10 and bore 47 is formed in stud 19 and both are screwed together. This may result in even a slight eccentricity between bore 47 and valve surface 15, since the threading in the FIG. 1-A embodiment is not as accurate as the drilling and reaming in the FIG. 2 embodiment. Additionally, threads usually introduce a certain amount of backlash.

Figure 3:
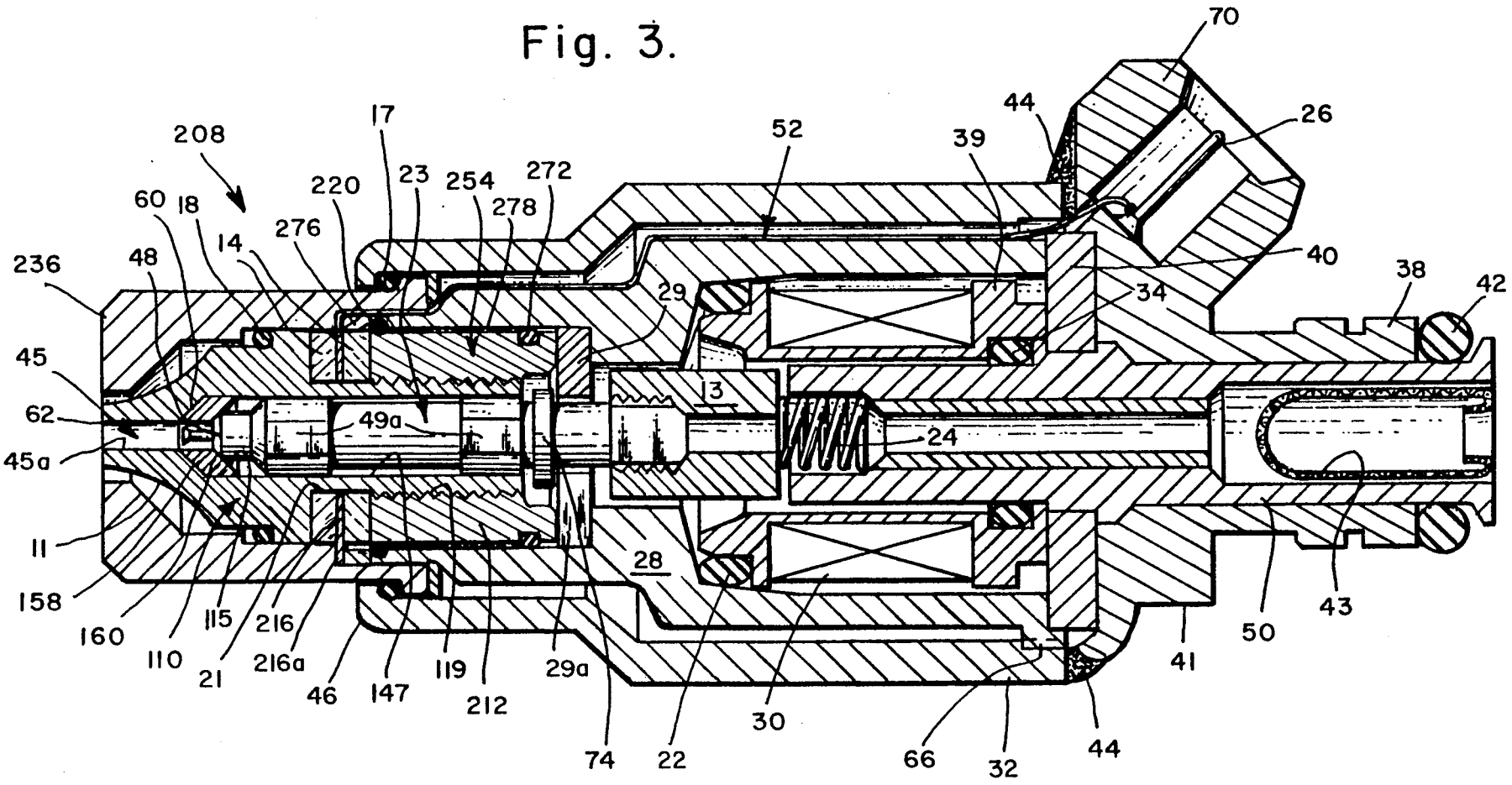
FIG. 3 shows a cross-sectional view of a preferred embodiment of the present invention.

FIG. 3 shows a cross-section of a preferred embodiment of an ultrasonic fuel injector 208 of the present invention. In this embodiment, those elements of injector 208, which are common to those of FIG. 1-A and/or FIG. 2, have the same part names and numbers while those, which are not common, are identified by a "200" series of numbers. A holder insert 276 and an O-ring 272 at the rear of horn 110 have been added, an O-ring 220 at the back of horn 110 has been moved, and stop washer 68 has been eliminated.

Horn driver assembly 254 of fuel injector 208 has been further altered from assemblies 54 and 154 respectively of FIGS. 1-A and 2 in the following way. The diameter of electrode 216 has been enlarged to form an extension 216*a*. The groove for O-ring 20 on compression member 12 to accommodate the swaged portion of inner housing 28 has been eliminated. The moving of O-ring 220 at the back of horn part 110 has been located axially between holder insert 276 and the front part of internal housing 28.

Driver assembly 254 is mounted partially inside the cavities of inner housing 28 and a front cap 236. Electrode 216 is made of a beryllium copper sheet of approx 0.2 millimeter thick, has an outside diameter on the order of 14 millimeters to 15 millimeters, and is compressed between crystal actuators 14. The portion or extension 216*a* of electrode 216 projecting beyond the outside surface of horn part 110 is held between front cap 236 and holder insert 276. End cap 236 is pressed by swaged portion 46 of outside housing 32 to electrode 216 which is thus compressed between front cap 236 and holder insert 276. Holder insert 276 compresses O-ring 220 against the face of inner housing 28, causing O-ring 220 to seal against the outside diameter of a compression member 212. O-ring 272 at the rear of horn part 110 has been placed in a groove in the back of compression member 212 to seal it against the bore of housing 28. A layer 278 of electrically conductive sealing material, such as a conductive nickel epoxy adhesive 2701 manufactured by Tra-Con, Medford, Mass., or a suitable electrically conductive grease, is placed over compression member 212 additionally to seal crystal actuators 14 and to provide electrical ground connection between compression member 212 and inner housing 28. Use of the electrically conductive seal material of layer 278 is necessary in this embodiment since there is no other electrically conductive connection between compression member 212 and housing 28.

Holder insert 276 is made of hard, plastic, electrically non-conductive material such as phenolic or fiber glass.

The outside diameter of insert 276, which is shaped as a ring, is slightly smaller than the matching internal diameter of front cap 236 and slightly smaller than the outside diameter of electrode 216.

The manner of attachment of horn driver assembly 254, as shown in the preferred embodiment in FIG. 3, provides certain advantages because mounting occurs at the nodal point (the point of zero velocity) of horn driver 254. Zero velocity occurs at a point between crystal oscillators 14. The amplitude of velocity and, thus also the amplitude of the stroke oscillations, gradually increases along the length of compression member 212 and along the length of tapered horn part 110.

OPERATION

Fuel is delivered under pressure of about 0.3 MPa through filter 43 inside the hole of solenoid core 50 and around flat portions 49*a* of shaft 23 to the proximity of valve surface 15 or 115. Electrical coil 30 is energized with voltage supplied from outside through connectors 26 and serves to pull pole piece 13 and shaft 23 away from conical seat 15 or 115 in stud 19 of FIG. 1-A (or horn part 110 in FIGS. 2 or 3), against the force of compressed spring 24.

Conical surface 48 of shaft 23 is lifted by approximately 0.1 millimeter away from valve seat 15 or 115, thus allowing fuel to flow through the opening thus created.

At the same time, oscillating voltage, having an amplitude on the order of 100 V and a frequency on the order of 30 to 100 kHz, is delivered to crystal actuators 14, causing them to oscillate. The narrowing of the size of a tapered section 11 of horn part 10 or 110 serves to amplify the oscillations of piezoelectric element 14 so that oscillations of a significant amplitude on the order of 0.01 millimeter is achieved on end of horn part 10 or 110.

Fuel, exiting through opening 45 in horn part 10 or 110, is atomized as a result of the impact of oscillating surface of tip 62 of horn part 10 or 110 on drops of the fuel to achieve a better mix between the fuel and the air. Such atomization of fuel, which occurs when a liquid comes in contact with an oscillating surface, may be a result of cavitation, and may occur when contact between an oscillating surface and a liquid causes a significant momentary pressure differential, allowing dynamic evaporation of liquid inside a drop of the liquid.

In a typical horn driver assembly, crystal actuators 14 operate on the principle of piezoelectricity. When an electric signal is applied across the width of crystal actuator 14, due to piezoelectric properties of PZT material, a change occurs in the physical dimension of the PZT transducer, which change leads to the creation of an acoustic wave in the medium surrounding crystal oscillator 14 if the signal is oscillating. In this case, the medium surrounding crystal oscillators 14 is a horn part 10 or 110 and a compression member. Oscillations are transmitted to both the titanium material of horn part 10 or 110 and the steel material compression member 12, 112 or 212.

Due to the good acoustic properties of titanium alloy (having a speed of sound of approximately 4877 m/s, density 4500 kg/m$^3$) oscillations are transmitted through the titanium and their speed and stroke is amplified as they pass through the tapered portion 11 of horn part 10 or 110. Typically, the stroke is on the order of 0.05 to 0.07 millimeters.

OBJECTS AND ADVANTAGES

Accordingly, besides the objects and advantages of the present invention described above, several objects and advantages of the present invention are:

(a) Providing an ability to better the atomization of liquid fuel and thus to improve the degree of mixing of fuel and air.

(b) Having an ability to improve engine performance through an improvement in consistency and quality of the mix between air and fuel.

(c) Having an ability to cause rapid evaporation of fuel as it contacts the oscillating surface.

(d) Having an oscillator member built with elements that meter and release fuel in one fuel injector part, thus allowing easy implementation.

(g) Having a relatively simple construction.

Further objects and advantages of the present invention will become apparent from a study of the drawings described herein.

SUMMARY, RAMIFICATION, AND SCOPE

Accordingly, it will be seen that the ultrasonic fuel injector of the present invention presents a novel application of ultrasound means of dispersion in fuel injectors. The device of the present invention permits substantial benefits over the existing fuel injectors.

The device of the present invention permits increased atomization of fuel which is injected into the intake manifold of an engine, and thus results in a better mixing of air and fuel and a partial evaporation of fuel in the intake manifold as a result of fuel cavitation.

Furthermore, the present invention has additional advantages in that:

- it allows for a simple and convenient operation,
- it allows for a relatively simple method of manufacturing
- the small diameter of the device permits its insertion into the conventional intake manifold of an internal combustion engine, and
- it allows for a convenient retrofit on existing engines, not requiring disassembly of the engine.

While the above description contains many specificities, they should not be construed as any limitation on the scope of the invention, but merely as exemplifications on the typical embodiments thereof.

Those skilled in the art will envision many other possible variations which are within its scope.

For example, skilled artisans will readily be able to change the dimensions and shapes of the various embodiments. They will also be able to make many variations on the shape, or entirely remove the outside housing, or change the geometry of the sealing shaft. They can also combine some parts into one, for instance tube fitting 38 and connector housing 70 with back plate 40.

The materials used for the parts of the ultrasonic fuel injector can also be varied, such as using other metals and plastic or plastic composites and employing different manufacturing techniques for their fabrication.

Similarly, one can vary the material used for the crystal actuators, such as barium titanate - $BaTiO_3$, or lead metaniobate or employ crystal actuators of different types, such as ones which operate on the principle of magnetorestriction.

Accordingly, the scope of the invention will be determined by the appended claims and their legal equivalents, and not by the examples which have been given.

I claim:

1. An ultrasonic fuel injector atomizer apparatus for injection of a fuel into an internal combustion engine comprising:

a housing;

a sealing shaft;

an actuator for said sealing shaft enclosed in said housing;

an electromechanical oscillator disposed around said sealing shaft, said electromechanical oscillator including a plurality of crystal actuators for converting electrical signals into mechanical oscillations;

a horn having (a) a generally tubular opening therein for ejection of the fuel and (b) a tapered part generally centered about the fuel opening and provided with an external taper for amplifying the mechanical oscillations;

a compression member for enabling pressure to be applied to said crystal actuators;

a conductor for conducting electrical signals to said crystal actuators;

said horn and said plurality of crystal actuators having openings including the fuel opening for permitting location of said sealing shaft at least partially inside the openings in said horn and said plurality of crystal oscillators to permit flow of a fuel around said sealing shaft and exit of the fuel into the internal combustion engine through the fuel opening in said tapered horn part, whereby the oscillations are amplified as they travel along said tapered horn part to result in augmented atomization of the fuel; and an electrode clamped to said crystal actuators and having an enlarged portion radially extending from said electrode beyond said compression member for support of said electromechanical oscillator in said housing.

2. An ultrasonic fuel injector atomizer apparatus according to claim 1 in which said electromechanical oscillator further includes a threaded member for attaching said compression member to said tapered horn part.

3. In an ultrasonic fuel injector atomizer apparatus, having a housing and a horn actuator assembly, said horn actuator assembly including a horn, a crystal actuator, a compression member, and an electrode member, the improvement comprising an extension of said electrode member extending beyond said compression member for support of said crystal actuator in said housing, and an attachment mechanism attaching said electrode member extension to said housing.

4. An electromagnetically operated ultrasonic fuel injector and atomizer apparatus comprising:

a housing;

a sealing shaft having a conical tip for sealing with a conical seat disposed within said housing;

a solenoid coil disposed within said housing for moving said sealing shaft tip into and out of engagement with said seat, thereby controlling the flow of fuel through a fuel outlet opening in said seat;

a hollow electromechanical oscillator assembly disposed around said sealing shaft, said oscillator assembly comprising:

a) a plurality of crystal actuators for converting electrical signals into mechanical oscillations;

b) a horn part for amplification of said mechanical oscillations;

c) a compression member attached to said horn part such that said crystal actuators are located between said compression member and said horn part, whereby said compression member causes pressure to be applied to said crystal actuators; and d) a flat circular electrode member clamped between an adjacent pair of said crystal actuators and having a portion extending radially beyond the outside diameter of said crystal actuators and said compression member;

means for clamping said radially extending portion of said electrode member within said housing for mounting said oscillator assembly to said housing;

said horn part, crystal actuators and compression member having aligned internal openings surrounding said sealing shaft such that fuel flows around said sealing shaft within said aligned openings;

whereby when said solenoid coil is excited and electrical signals are supplied to said crystal actuators via said electrode member, said sealing shaft tip is moved out of engagement with said seat and fuel exiting through said outlet opening is atomized by oscillations of said horn part.

5. An ultrasonic fuel injector atomizer apparatus for atomizing fuel, comprising:

a housing;

a generator for generating oscillations;

a horn including an externally tapered section coupled to said generator and provided with a generally tubular opening for dispensing the fuel, said tapered section being shaped to increase the amplitude of the oscillations at the opening and thereby to improve atomization of the fuel;

a compression member positioned to compress said generator against said tapered horn section, in which said horn is provided with an internally threaded bore and said compression member includes an externally threaded stud integrally formed thereon for threaded engagement with the bore for securing said horn, said compression member and said generator together into a unit; and a valve coupled to a source of the fuel and having a valve stem with a sealing surface centered within said horn and said compression member and a valve seat formed on said compression member stud and positioned adjacent to said fuel dispensing opening.

6. An ultrasonic fuel injector atomizer apparatus according to claim 5 further comprising an actuator for actuating said valve stem and said sealing surface thereon into and out of sealing engagement with said valve seat.

7. An ultrasonic fuel injector atomizer apparatus for atomizing fuel, comprising:

a housing;

a generator for generating oscillations;

a horn including an externally tapered section coupled to said generator and provided with a generally tubular opening for dispensing the fuel, said tapered section being shaped to increase the amplitude of the oscillations at said opening and thereby to improve atomization of the fuel;

a compression member positioned to compress said generator against said tapered horn section, in which said compression member is provided with an internally threaded bore and said horn includes an externally threaded stud integrally formed thereon for threaded engagement with the bore for securing said horn, said compression member and said generator together into a unit; and a valve coupled to a source of the fuel and having a valve stem with a sealing surface centered within said horn and said compression member and a valve seat formed on said horn and positioned adjacent to said fuel dispensing opening.

8. An ultrasonic fuel injector atomizer apparatus for atomizing fuel, comprising:

a housing;

a generator for generating oscillations; and a horn including an externally tapered section coupled to said generator and provided with a generally tubular opening for dispensing the fuel, said tapered section being shaped to increase the amplitude of the oscillations at said opening and thereby to improve atomization of the fuel a compression member positioned to compress said generator against said horn tapered section, an electrode having an extension extending beyond said compression member for support of said generator in said housing, and an attachment mechanism attaching and supporting said electrode extension to and within said housing.

* * * * *